US006306002B1

(12) United States Patent
Kaneko et al.

(10) Patent No.: US 6,306,002 B1
(45) Date of Patent: Oct. 23, 2001

(54) LAMP AND MANUFACTURING METHOD THEREOF

(75) Inventors: Yuriko Kaneko; Makoto Horiuchi, both of Nara; Mamoru Takeda, Kyoto; Masato Yoshida; Yoshitaka Kurimoto, both of Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/317,207

(22) Filed: May 24, 1999

(30) Foreign Application Priority Data

May 25, 1998 (JP) ..... 10-142690

(51) Int. Cl.[7] ..... H01J 9/32
(52) U.S. Cl. ..... 445/26; 445/43; 445/27
(58) Field of Search ..... 445/26, 27, 43

(56) References Cited

U.S. PATENT DOCUMENTS 3,685,880 * 8/1972 Sobieski ..... 445/26
5,936,349 * 8/1999 Fukai et al. ..... 445/43
5,984,749 * 11/1999 Nishibori et al. ..... 445/27

FOREIGN PATENT DOCUMENTS 4-58434 2/1992 (JP) .
5-159743 6/1993 (JP) .
6-318434 11/1994 (JP) .
7-262967 10/1995 (JP) .
8-17346 1/1996 (JP) .
11-16540 1/1999 (JP) .
11-67093 3/1999 (JP) .

* cited by examiner

*Primary Examiner*—Kenneth J. Ramsey
(74) *Attorney, Agent, or Firm*—Wenderoth, Lind & Ponack, L.L.P.

(57) ABSTRACT

A lamp made of a tube having a light emission portion glass and a side tube portion glass that extends in the light emission portion glass. The lamp has a sealed electrode assembly having an electrical current supply line with one end portion connected to a metal foil. A first portion of the side tube portion where an electrical current supply line is located is heated and this portion is compressed by a first pressure. A second portion of the side tube portion where a metal foil is located is heated and this portion is compressed by a second pressure. The second pressure is made larger than the first pressure.

16 Claims, 13 Drawing Sheets

LAMP AND MANUFACTURING METHOD THEREOF

BACKGROUND OF THE INVENTION

1. Field of the Invention

The present invention relates to a lamp and a manufacturing method of that lamp that has a special structure of electrode sealing and whose internal pressure become one atmosphere or more when operated to light it.

2. Description of the Prior Art

Conventionally, high intensity discharge lamps have been widely used for ordinary illumination in homes, facilities and stores. In recent years, these lamps are being used as light sources for overhead projectors, projection televisions and motion picture projectors. The reason for this is because high intensity discharge lamps emit an extremely bright light.

In particular, in recent years, research has been active on ways to bring lamps closer to a point light source by shortening the length of the discharge arc. However, reductions in lamp voltage occur following efforts to shorten the length of the discharge arc. Therefore, when an attempt is made to operate a lamp using an identical voltage, increases in lamp current generate. These increases in lamp current are linked to large increases in electrode loss, actively vaporize electrode materials worsening the early stages of electrodes. Namely, the increases in lamp current cause the lifecycles of the lamps to shorten. From this type of reason, when shortening the arc length, it is normal to increase the mercury vapor pressure when operating the lamp is made to protect against reductions in lamp voltage (increases in lamp current).

When the mercury vapor pressure and other similar parameters are made to increase when operating the lamp, the lamp must be constructed such that it will not be cracked due to that high operating pressure.

FIG. 11 shows the structure of a conventional discharge lamp. In the figure, 100 is a light emission portion wherein exists a discharge arc and 101 is a side tube portion that extends from light emission portion 100. Light emission portion 100 and side tube portion 101 are both comprised by quartz glass.

A gas that becomes a high pressure when the lamp is operated is sealed in light emission portion 100. Further, 102 is an electrode that functions to supply electrical current into light emission portion 100. The electrode material is normally tungsten. In comparison to the thermal expansion coefficient of tungsten of $5.2\times10^{-6}$, the thermal expansion coefficient of quartz glass is $5.5\times10^{-7}$ that is almost one decimal place different. Technology for sealing methods of two types which differ greatly in this way is difficult.

For a sealing method for this case a foil sealing structure is known wherein a metal foil 104 connects between electrode 102 and an external electrical current supply line 103 and glass being sealed airtight in this metal foil. By carrying out plastic deformation on an extremely thin metal foil, the difference in the thermal expansion coefficient between the glass and the metal is absorbed making it possible to obtain a seal.

Conventionally, pinch sealing is a manufacturing method of this foil sealing structure lamp. In the following, conventional pinch sealing will be described referring to FIG. 12. Glass tube 110 is formed by a separate process in which a quartz glass tube is heated and allowed to expand forming light emission portion 100 in a specified shape. A quartz glass tube that is not deformed is connected to both end portions of light emission portion 100 as side tube portion 101. Glass tube 110 is retained by a chuck 113. The end portion of electrode 102 is disposed on light emission portion 100 to maintain a discharge arc. And also, electrode 102, metal foil 104 (connected to the other end portion of electrode 102) and electrical current supply line 103 are disposed on side tube portion 101.

Further, in order to prevent electrode oxidation during the sealing process, side tube portion 101 maintains in a rare gas environment. The glass of this side tube portion 101 is thermally fused by a burner 111 and then pressure formed by a forming die 112 from two directions perpendicular to the surface of metal foil 104.

Problems to be Solved

The following two problems exist when using this type of sealed lamp.

Electrode 102 and the glass of side tube portion 101 have different thermal expansion coefficients and there is no airtight seal. Thereupon, a gap can be opened between electrode 102 and the glass of side tube portion 101.

FIG. 13 shows the cross sectional shape of the side tube portion along line 105 shown in FIG. 11. In the figure, 120 is a side tube portion glass. Further, 121 is a gap between electrode 102 and side tube portion glass 120. The shape of gap 121 has a sharp notch 122 due to squeezing from two directions of the glass. There was a problem of a concentration of stress acting on sharp notch 122 and the lamp being damaged due to a pressure lower than the pressure strength actually possessed by the glass.

The second problem is a crack 106 shown in FIG. 11. This crack 106 occurs in the side tube portion glass at the position of electrode 102. The percentage of cracks which occur during sealing is larger than cracks which occur due to differences in the thermal expansion coefficients of the electrode and the glass. However, this crack has an action that is said to lessen the stress occurring between the electrode and the glass when lighting and extinguishing the lamp. Because of this, cracks which occur due to differences in the thermal expansion coefficients do not interfere with the lamp.

Cracks which occur because of differences in the thermal expansion coefficients however, occur due to another mechanism. The electrode does not cause plastic deformation as with a metal foil. Because of this, if the electrode is struck by the side tube portion glass with a strong force, the glass will crack due to that impact. A concentration of stress will generate at the tip of this crack which will further lower the pressure strength of the lamp. In other words, there is a problem of cracks occurring due to factors other than differences in the thermal expansion coefficients of the glass and the electrode.

Thereupon, a shrink seal method is used to solve the above-mentioned two problems. An example of a shrink seal method is shown in FIG. 14. Glass tube 110 is retained by chuck 126. The end portion of electrode 102 is disposed on light emission portion 100 to maintain a discharge arc. And also, electrode 102, metal foil 104 (connected to the other end portion of electrode 102) and electrical current supply line 103 are disposed on side tube portion 101. A reduced pressure state is maintained inside glass tube 110. While this glass tube 110 is rotated in the circumferential direction of the tube (approximately indicated by arrow 128), side tube portion 101 is thermally fused uniformly by burner 127. Side tube portion 101 glass undergoes diameter reduction by means of a pressure difference between the inside and outside of glass tube 110 and then metal foil 104 and side tube portion 101 glass positioned where the metal foil is located are sealed airtight.

According to this method, because the glass undergoes diameter reduction towards the electrode, the shape of the gap between the glass and the electrode becomes almost circular eliminating the notch portion that generates a concentration of stress. Further, because the sealing pressure does not exceed the atmospheric pressure, the glass does not receive any impact when sealed.

However, because the sealing pressure of the metal foil portion does not exceed one atmosphere in this shrink seal method, there are still remaining problems of an insufficient amount of plastic deformation of the metal foil and a weak seal between the metal foil and the glass tube.

Thereupon, a method has been attempted that uses a die to evenly squeeze the glass (for example, a polygon shaped die or a circular die) in order that the shape of the gap between the electrode and the glass does not have a notch portion and that additionally removes cracks occurring in the side tube portion glass positioned where the electrode is located from the rear.

For example, Japanese Patent Laid-open Publication (Kokai) HEI 5-159743 discloses a method which attempts to eliminate cracks by reheating and gradually cooling the side tube portion after pinch sealing.

However, in order to eliminate cracks, the glass temperature must be increased up to the softening point. The softening point of quartz glass is 1683° C. FIG. 11 shows the state of crack 106. In particular, a location 122 (FIG. 13) where a crack occurs is adjacent to light emission portion 100. Because an electrode is embedded in side tube portion 101, light emission portion 100 is also greatly affected by temperature. Light emission portion 100 is formed in an approximate spherical shape and the tip of the light emission portion adjacent to the side tube portion has a thin skin of glass making it especially vulnerable to deformation due to temperature increases. Deformation of the light emission tube changes the temperature of the coolest point inside the light emission tube when the lamp is operated (lowest point in the direction of the gravitational force of light emission portion 100 when the axial direction of the side tube portion is set in the horizontal direction and used in that manner). The vapor pressure of the light emitting material inside the lamp is determined by the coolest temperature point inside the light emission tube when the lamp is operated. In other words, deformation of the light emission tube causes the vapor pressure of the light emitting material inside the lamp to change thereby changing the spectral distribution characteristics. Because of these factors, eliminating cracks after the sealing process is passed through is difficult.

Further, an explanation was provided for the above-mentioned discharge lamp although this is not a specific problem for a discharge lamp and when hermetically sealing an electrical current supply line inside a glass tube, the same problems occur. In other words, the same problems exist in an incandescent lamp of a halogen light bulb.

The object of the present invention is to take these factors into consideration and provide a lamp with the following improvements. Eliminates concentration of stress occurring in the gap between the glass and electrode. Controls to a minimum the occurrence of cracks which occur due to factors other than differences in the thermal expansion coefficients of the glass and the electrode. And in addition has a high pressure strength structure with improved adhesiveness between the metal foil and the glass.

Means for Solving the Problem

In order for the present invention to achieve the above-mentioned objects, a method is used to produce a discharge lamp wherein an electrode assembly is hermetically sealed that comprises at least an electrical current supply line and a metal foil connected to the electrical current supply line to produce a lamp in the following process. A side tube portion housing the metal foil portion is compressed at the metal foil portion by a pressure higher than the pressure that compresses the side tube portion at the electrical current supply line. As a result, the process hermetically seals the metal foil portion in a state in which the electrode assembly (positioned such that one portion of the electrode is inside the light emission portion) is inserted inside a glass bulb that comprises at least a light emission portion and a side tube portion extending into the light emission portion.

Further, the lamp of the present invention is characterized by having a light emission portion comprised by glass, a side tube portion that extends from the light emission portion and is comprised by glass as well as an electrical current supply line with one portion arranged inside the light emission portion, one end portion connected to a metal foil, and that is hermetically sealed in the side tube portion. The lamp is further characterized by the lateral cross sectional shape in the perpendicular direction of the axis of the electrical current supply line of the gap between the electrical current supply line and the side tube portion having a shape similar to the cross section of the electrical current supply line as well as the side tube portion glass located at the position of the metal foil portion being compression formed by a die.

The lamp of the present invention is further characterized by having an electrode with one portion arranged inside the light emission portion together with one end portion connected to a metal foil. The end portion connected to the metal foil is hermetically sealed in a side tube portion extending from the light emission portion. Furthermore, the lateral cross sectional shape in the perpendicular direction of the axis of the electrical current supply line of the gap between the electrical current supply line and the side tube portion has a smooth shape without notches which cause a concentration of stress, and the side tube portion positioned where the metal foil is located is compression formed by a forming die.

EMBODIMENTS OF THE PRESENT INVENTION

In the following, embodiments of the present invention will be described with reference to the attached drawings.

(First Embodiment)

In the following, a first embodiment of a discharge lamp of the present invention will be described with reference to FIG. 1 to FIG. 3. FIG. 3 shows the structure of a discharge lamp of a first embodiment of the present invention.

In FIG. 3, 1 is a light emission portion comprised by glass and 2*a* and 2*b* are both side tube portions comprised by glass which extend from light emission portion 1. Further, an electrode assembly is hermetically sealed in here that connects metal foil 4 between electrode 3 and external electrical current supply line 5 connected to a power supply (not shown in figure). A gas that becomes a high pressure when the lamp is operated is sealed in light emission portion 1 in like manner to a conventional discharge lamp.

Figure 2A:
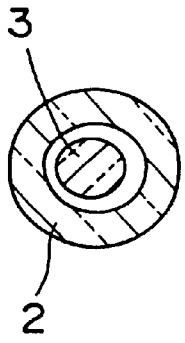
FIG. 2A is an enlarged cross section along dashed line 6 of FIG. 3.
Figure 2B:
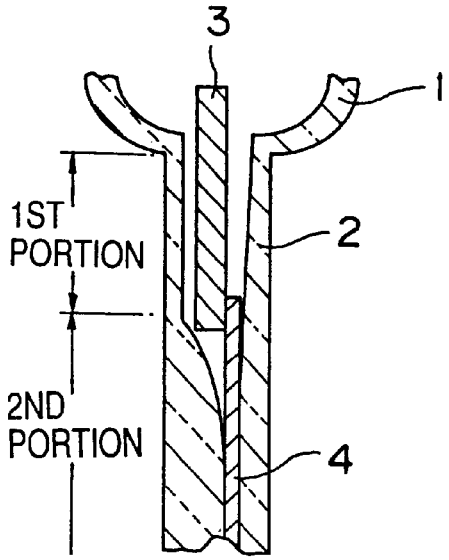
FIG. 2B is an enlarged cross section along dashed line 7 of FIG. 3.
Figure 3:
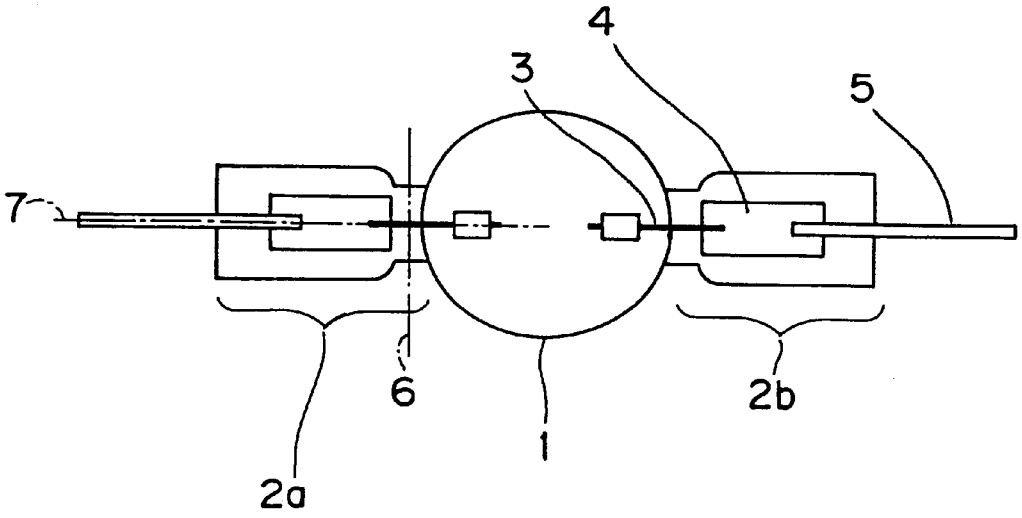
FIG. 3 shows the structure of a discharge lamp of a first embodiment of the present invention.

FIG. 2A is an enlarged cross section along dashed line 6 of FIG. 3 and FIG. 2B is an enlarged cross section along dashed line 7 of FIG. 3.

The structure of the lamp of the first embodiment is characterized by the lateral cross sectional shape of the gap between electrode 3 and side tube portion glass 2 having a shape similar to the lateral cross sectional shape of the electrode and the side tube portion glass positioned where metal foil 4 is located being formed by a die.

As shown in FIG. 2B, the side tube portion glass 2 related to the present invention has a first portion wherein electrode 3 is inserted and retained and a second portion wherein metal foil 4 is inserted and retained.

The manufacturing method in the first embodiment initially uses a shrink seal method and then softens the first portion utilizing heat to reduce the diameter. For this case, the portion inside the glass tube is brought to a pressure lower than atmospheric pressure to reduce the diameter. Continuing, as shown at the lower right of FIG. 1, a forming die is positioned at any of levels L1, L2 or L3, namely, the die is set at the connection portion between electrode 3 and metal foil 4 to carry out pinch sealing. For a lamp manufactured using a conventional pinch sealing method, as shown at the lower left of FIG. 1, the forming die is set at the position of level L0 which is the boundary portion between light emission portion 1 and side tube portion glass 2.

In order to reduce the diameter in the manufacturing process of the present invention, pressure added to the second portion of the side tube portion glass is a value larger than the pressure added to the first portion. Because of this, stress on the side tube portion glass of the first portion is applied evenly to prevent cracks from easily occurring along with a high pressure being applied to the side tube portion glass of the second portion thereby improving the adhesiveness between the metal foil and the side tube portion glass.

Further, the boundary between the first portion and the second portion can be a portion where electrode 3 and metal foil 4 overlap or a portion close to that.

Figure 1:
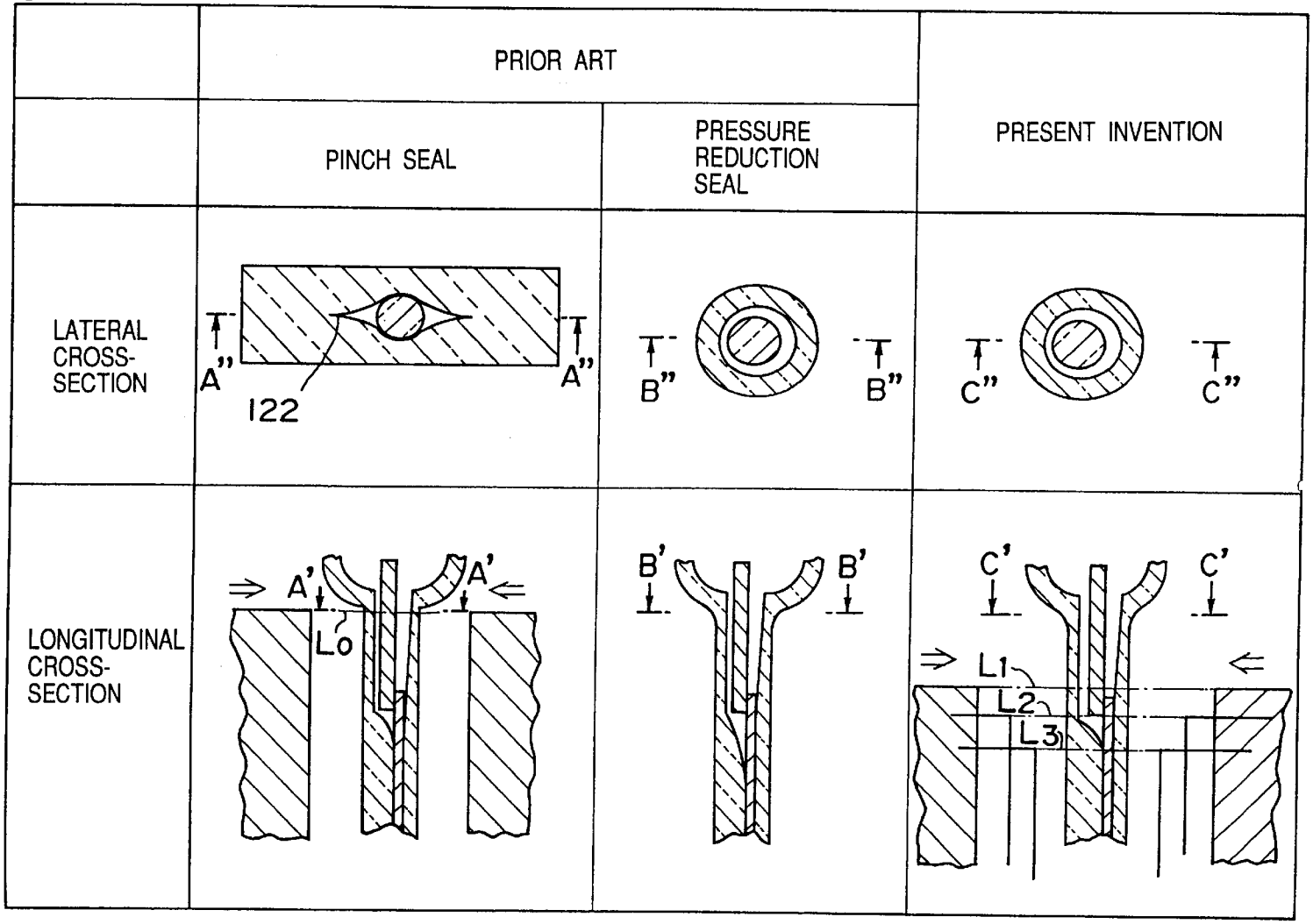
FIG. 1 shows a comparison of the structure of a discharge lamp of a first embodiment of the present invention and a conventional discharge lamp.

In order to describe the differences between a lamp with a conventional structure and the lamp of the first embodiment, the cross sectional views of side tube portion 6 and portion 7 are both shown in FIG. 1. In FIG. 1, left column, top view is a cross-sectional view taken along a line A'—A' shown in left column bottom view, and the left column, bottom view is a cross-sectional view taken along a line A"—A" shown in left column top view. Similarly, the views in the center column are the cross-sectional views taken along lines B'—B' and B"—B" shown in counterpart views, and the views in the right column are the cross-sectional views taken along lines C'—C' and C"—C" shown in counterpart views. The views in the left column are prior art lamp formed by pinch seal method. The views in the center column are prior art lamp formed by shrink seal method. The views in the right column are present invention lamp formed by the method of the present invention.

A lamp with a conventional structure undergoes pinch sealing and shrink sealing.

In a lamp with a pinch sealing structure as shown in the left column in FIG. 1, the adhesiveness between the metal foil and the side tube portion glass is strong. However, there is a notch portion 122 that generates a concentration of stress in the gap between the electrode and the side tube portion glass.

In a lamp with a shrink sealing structure as shown in the center column in FIG. 1, a concentration of stress in the gap between the electrode and the side tube portion glass does not occur. However, the adhesiveness between the metal foil and the side tube portion glass becomes weak because of insufficient pressure.

By means of providing a seal structure as in the discharge lamp of the first embodiment as shown in the right column in FIG. 1, a concentration of stress in the gap between the electrode and the side tube portion glass does not occur, and the adhesiveness of the metal foil is high. When the second portion of the side tube portion glass cracks in the lamp of the present invention, cracking similar to the metal foil peeling does not occur. The side tube portion glass cracks in a direction that is roughly perpendicular or is at angle to the metal foil portion.

In this way, it is preferable for the cross sectional shape of the gap between the electrode 3 and the first portion of side tube portion glass 2 to be a smooth shape without notch portions which generate a concentration of stress. For example, the shape can be circular, approximately circular, or an elliptical, approximately elliptical.

Moreover, it is preferable for the second portion of side tube portion glass 2 positioned where metal foil 4 is located to reach to the area around the connection portion between the electrode and the metal foil. This allows even more improvement of the adhesiveness between the metal foil and the side tube portion glass.

(Second Embodiment)

Figure 4:
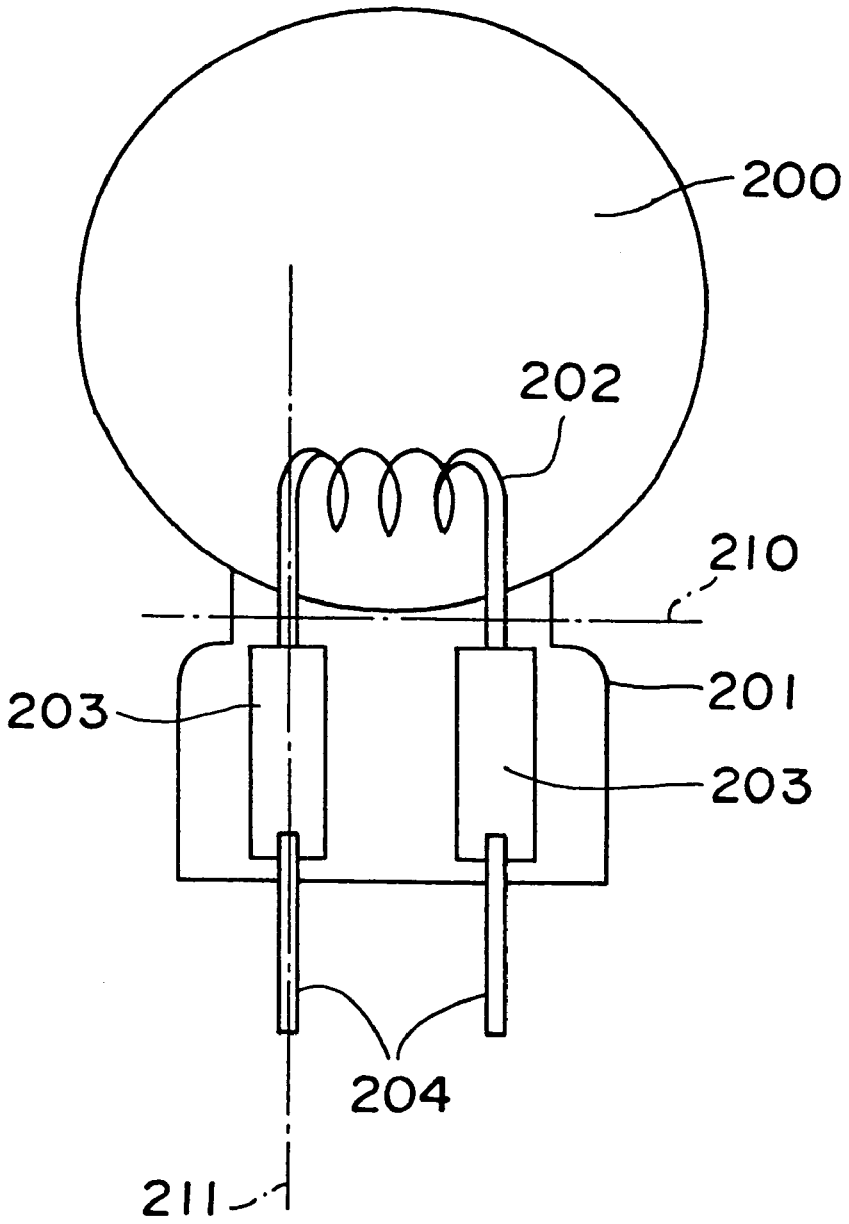
FIG. 4 shows the structure of an incandescent lamp of a second embodiment of the present invention.

In the following, a second embodiment of an incandescent lamp of the present invention will be described with reference to FIG. 4 and FIG. 5. FIG. 4 shows the structure of a incandescent lamp of a second embodiment of the present invention.

In FIG. 4, 200 is a light emission portion comprised by glass and 201 is a side tube portion comprised by glass which extends from light emission portion 200. Further, the electrode assembly is hermetically sealed in side tube portion 201. Both end portions of the electrode assembly are connected to metal foil 203 and external electrical current supply line 204 (connected to a power supply) is connected to electrical current supply line 202 of which one portion (positioned where light emission portion 200 is located) is formed in a coil shape as well as to the other end portion of the metal foil. A gas that becomes a high pressure when the lamp is operated is sealed in light emission portion 200.

Figure 5A:
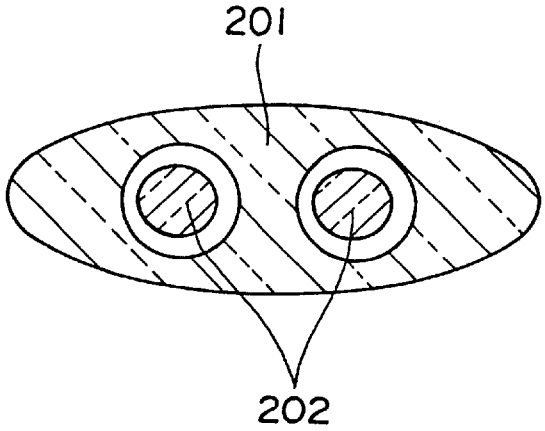
FIG. 5A is an enlarged cross section along dashed line 210 of FIG. 4.
Figure 5B:
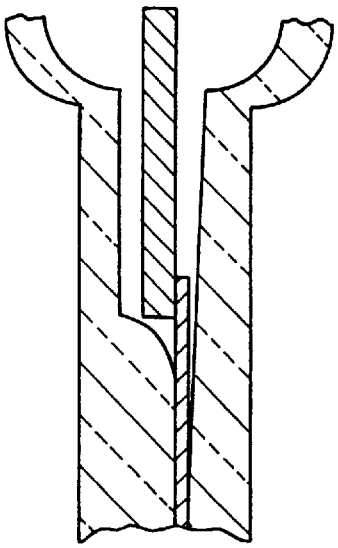
FIG. 5B is an enlarged cross section along dashed line 211 of FIG. 4.

FIG. 5A shows an enlarged cross sectional shape along side tube portion glass 210 positioned where electrical current supply line 202 of FIG. 4 is located and FIG. 5B shows an enlarged cross sectional shape along side tube portion 211.

The structure of the lamp of the second embodiment is characterized by the lateral cross sectional shape of the gap between electrical current supply line 202 and the side tube portion glass having a shape similar to the lateral cross sectional shape of electrical current supply line 202 and the side tube portion glass positioned where metal foil 203 is located being formed by a die.

The incandescent lamp of the second embodiment does not have a concentration of stress occurring in the gap between the electrode and the side tube portion glass. The adhesiveness of the metal foil is also high.

(Third Embodiment)

FIG. 6 to FIG. 9 describe an embodiment of the manufacturing method of the lamp of the present invention.

Figure 6:
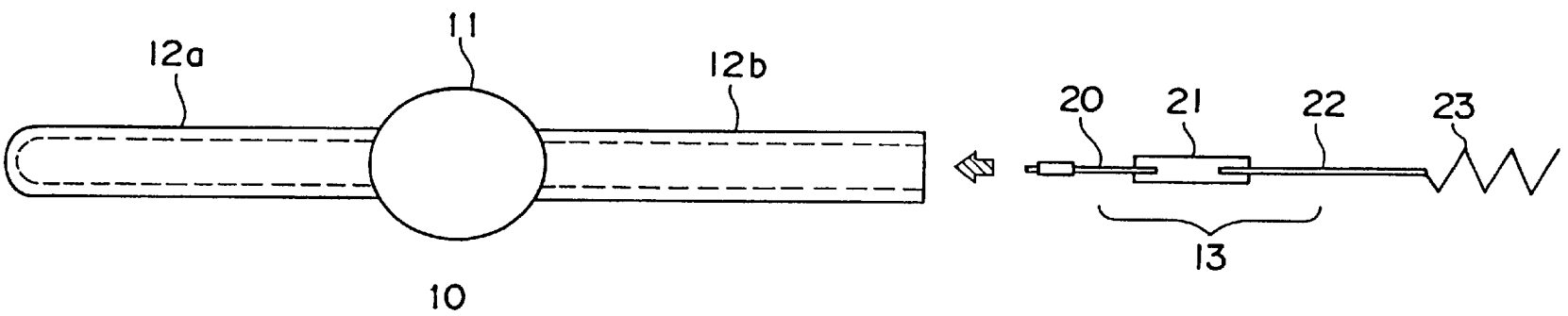
FIG. 6 shows a manufacturing method of a discharge lamp of a second embodiment of the present invention.

In FIG. 6, 10 is a glass tube formed by a separate process wherein a quartz glass tube heats and is expanded and is comprised by light emission portion 11 formed in a specified shape and side tube portions 12*a* and 12*b* of the quartz glass tube which extend from both end portions of light emission portion 11. The end portion of the other side tube portion 12*a* is sealed.

In contrast, electrode assembly 13 consists of electrode 20, metal foil 21 connected to electrode 20, and electrical current supply line 22 connected to the end portion of the metal foil portion on the side opposite to where the metal foil portion is connected to electrode 20. A spring 23 is mounted to the end portion of metal current supply line 22 on the side not connected to the metal foil. Electrode assembly 13 attached to spring 23 inserts from the opening of side tube portion 12*b* and the end portion of the metal foil of the electrode not connected is arranged towards the light emission portion. By pressing the inner surface of the side tube portion glass on the spring connected to electrode assembly 13, electrode assembly 13 is secured at a specified position.

Figure 7:
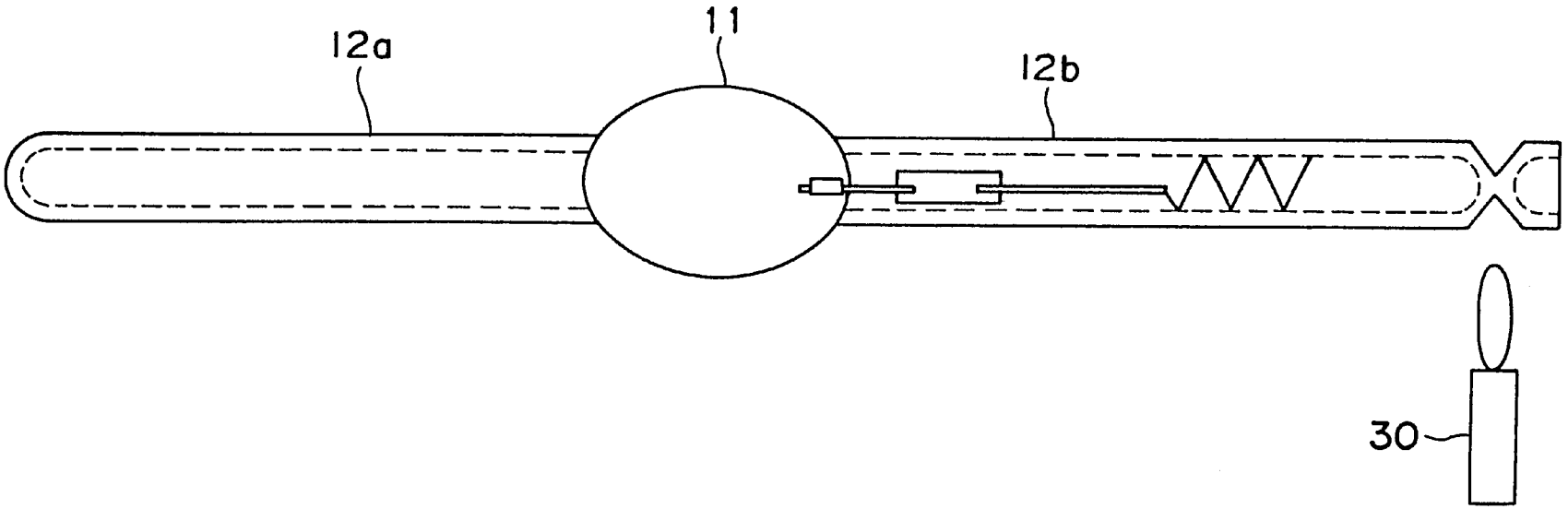
FIG. 7 shows a manufacturing method of a discharge lamp of a second embodiment of the present invention.

In this state, at first, after carrying out a vacuum discharge from the opening of side tube portion 12*b*, 200 mbar of argon gas is injected from the opening of side tube portion 12*b*. Then, the periphery of the end portion of side tube portion 12*b* not yet sealed is heated by burner 30 and sealed as shown in FIG. 7.

Figure 8:
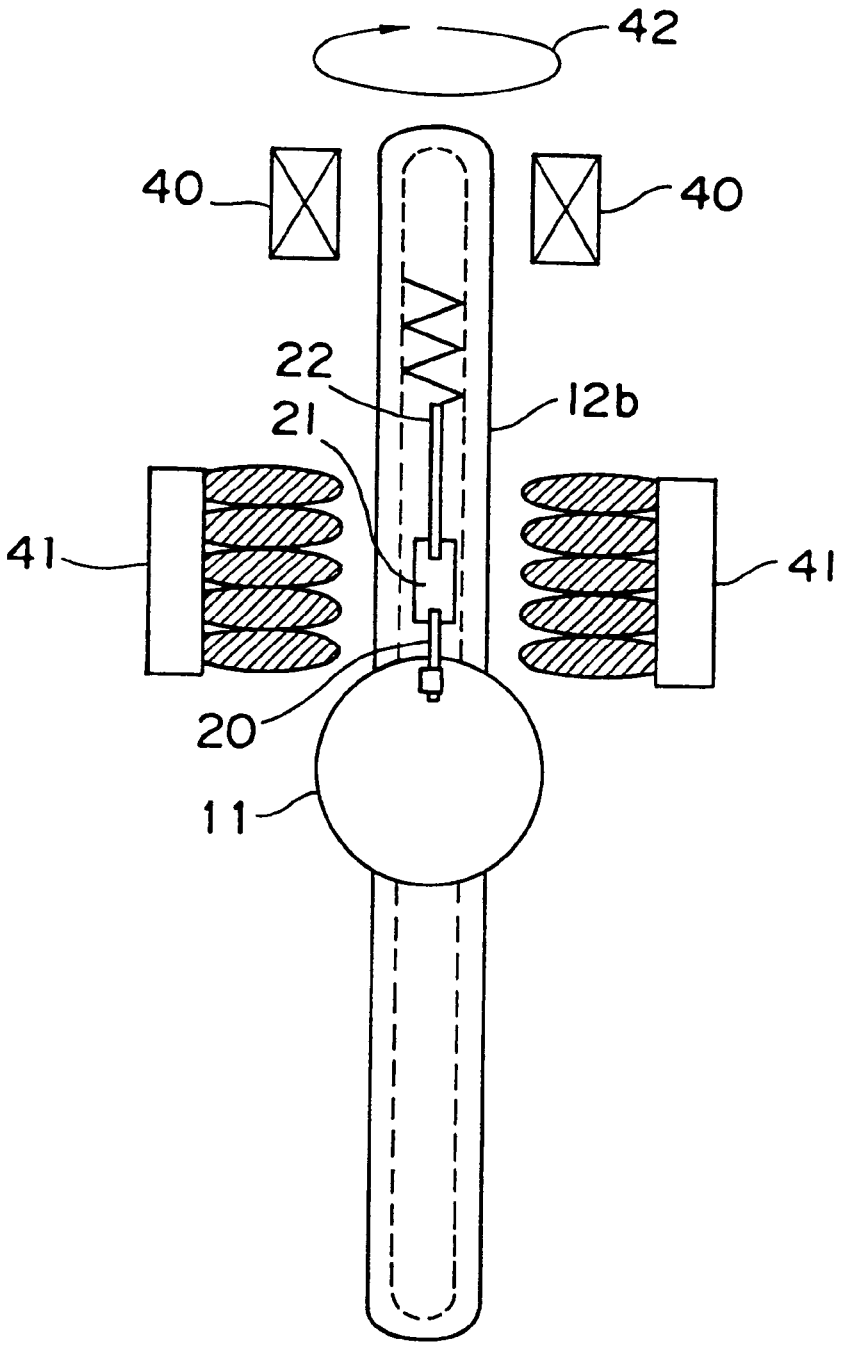
FIG. 8 shows a manufacturing method of a discharge lamp of a second embodiment of the present invention.

Continuing, as shown in FIG. 8, the end portion of side tube portion 12*a* of glass tube 10 is held by chuck 40 in a state in which argon gas is at 200 mbar and electrode assembly 13 is inserted. Next, glass tube 10 rotates in the direction of the circumference of the valve (indicated by arrow 42). Then, the glass tube is heated and softened by means of burner 41 (heating element) reaching to one portion of a metal lead-in wire 22 positioned where side tube portion 12*b* is located from the boundary of light emission portion 11 and side tube portion 12*b*.

At this time, because the inside of glass tube 10 is in a reduced pressure state, the inside diameter of side tube portion 12*b* is reduced at the softened position by means of a pressure difference between the surrounding atmospheric pressure of glass tube 10. In particular, after the diameter of the inner surface of the glass of side tube portion 12*b* positioned where electrode 20 is located is reduced up to the area around the electrode, the heating of burner 41 and the rotation 42 of glass tube 10 lease.

Figure 9:
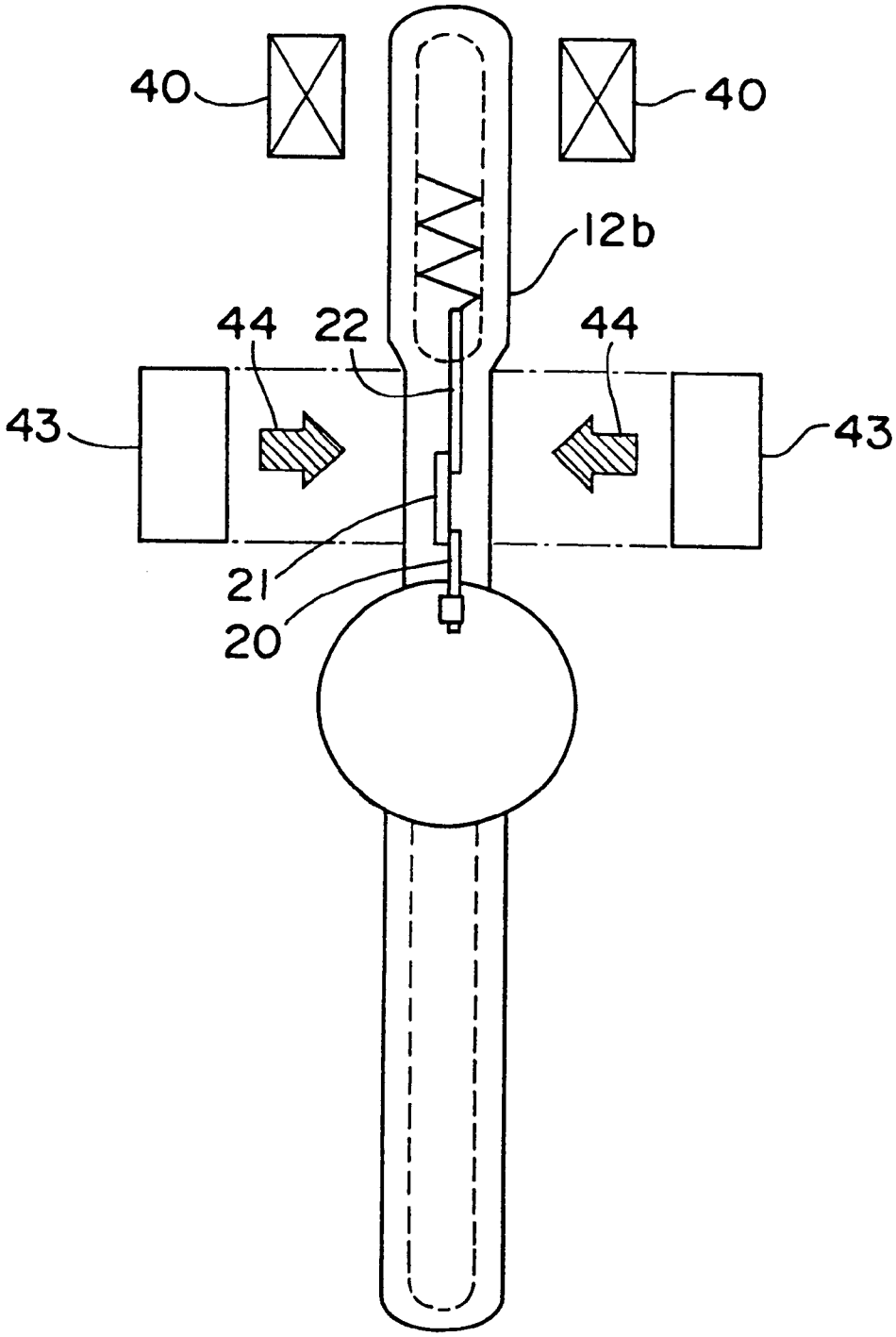
FIG. 9 shows a manufacturing method of a discharge lamp of a second embodiment of the present invention.

Now, as shown in FIG. 9, the side tube portion 12*b* glass positioned where metal foil 21 is located is squeezed by die 43 from two directions perpendicular to the plane of metal foil 21 (indicated by arrow 44). At this time, it is preferable for the squeezing action of die 43 to cease almost simultaneous when the heating of burner 41 ceases. This is to improve the adhesiveness between the glass and the metal foil by means of squeezing the glass in a sufficiently softened state. In this manner the electrode sealing of side tube portion 12*b* is complete.

(Fourth Embodiment)

Figure 10:
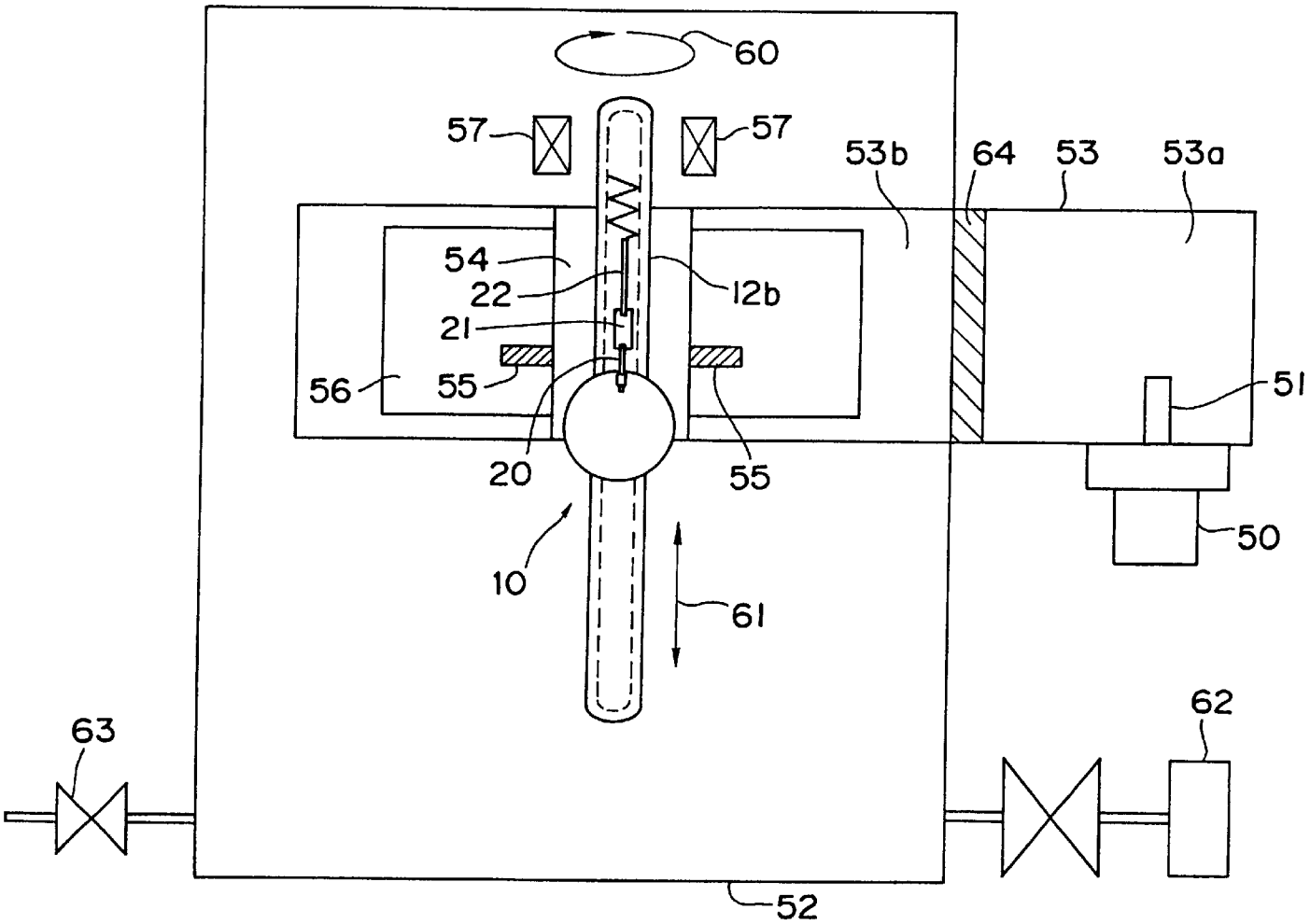
FIG. 10 shows a manufacturing method of a discharge lamp of a third embodiment of the present invention.
Figure 11:
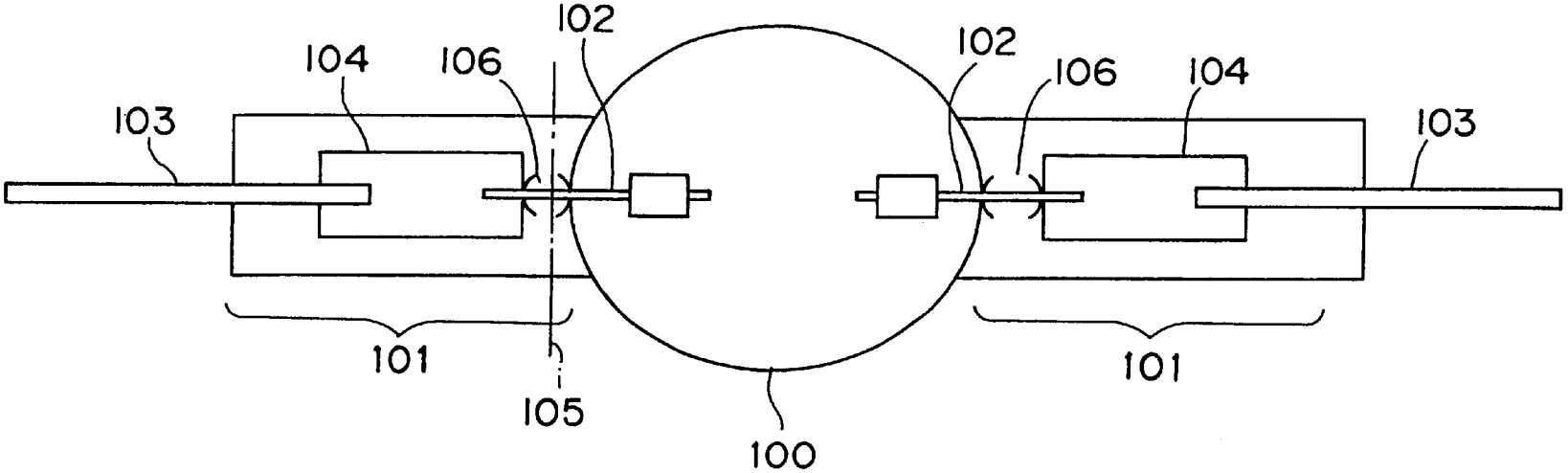
Fig. 11 PRIOR ART
FIG. 11 shows the structure of a conventional discharge lamp.
Figure 12:
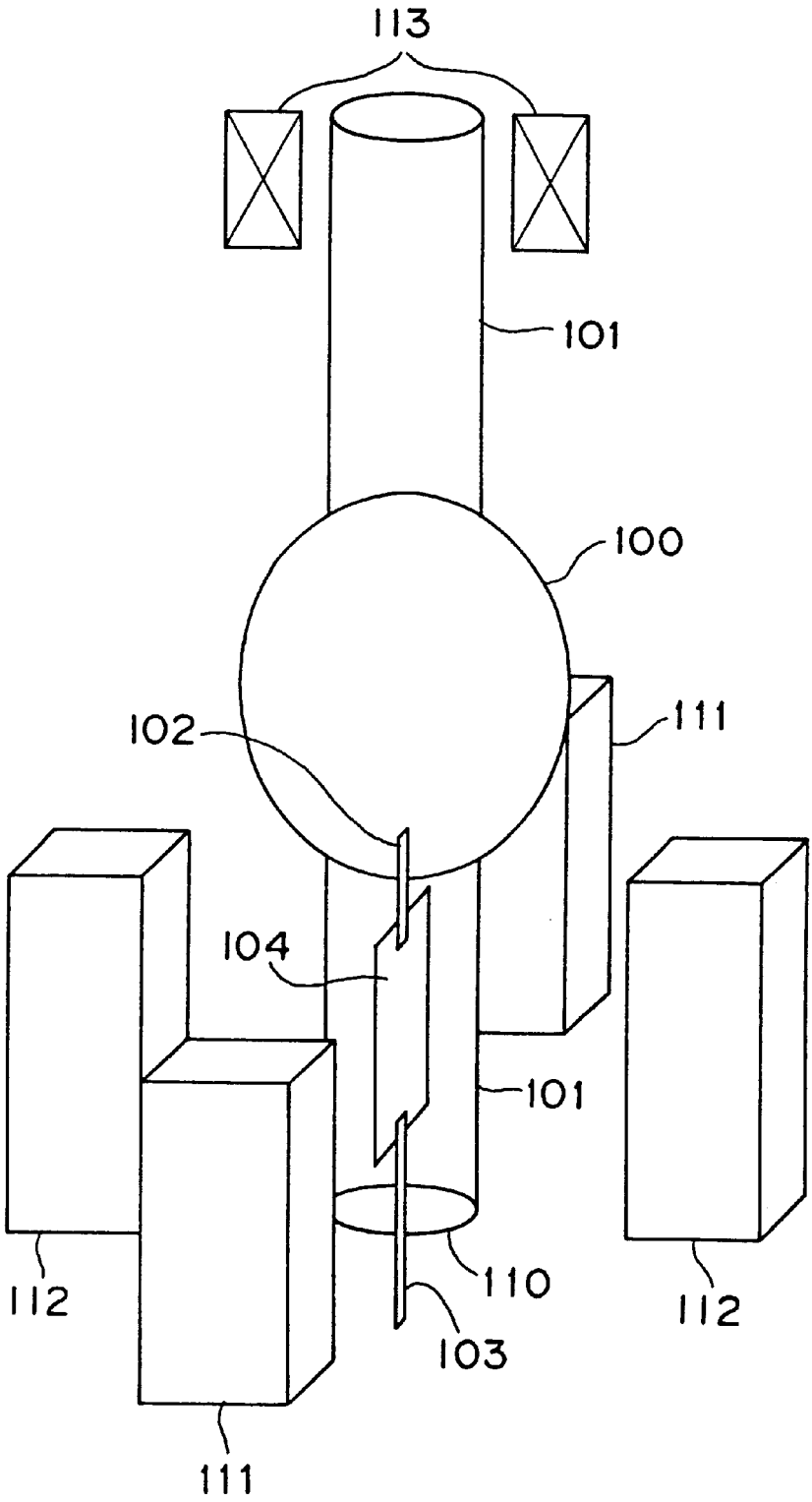
Fig. 12 PRIOR ART
FIG. 12 shows a manufacturing method (pinch sealing) of a conventional discharge lamp
Figure 13:
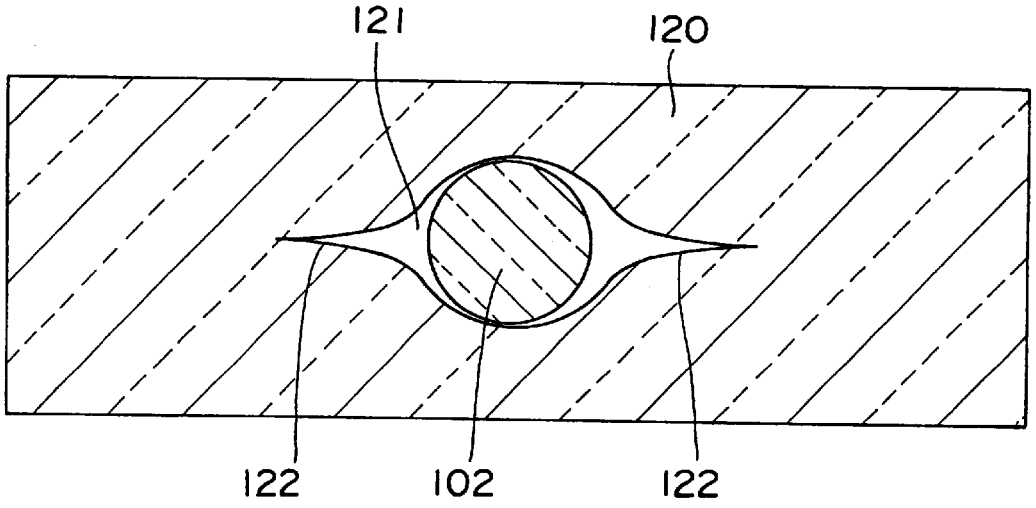
Fig. 13 PRIOR ART
FIG. 13 is an enlarged cross section along dashed line 105 of FIG. 11.
Figure 14:
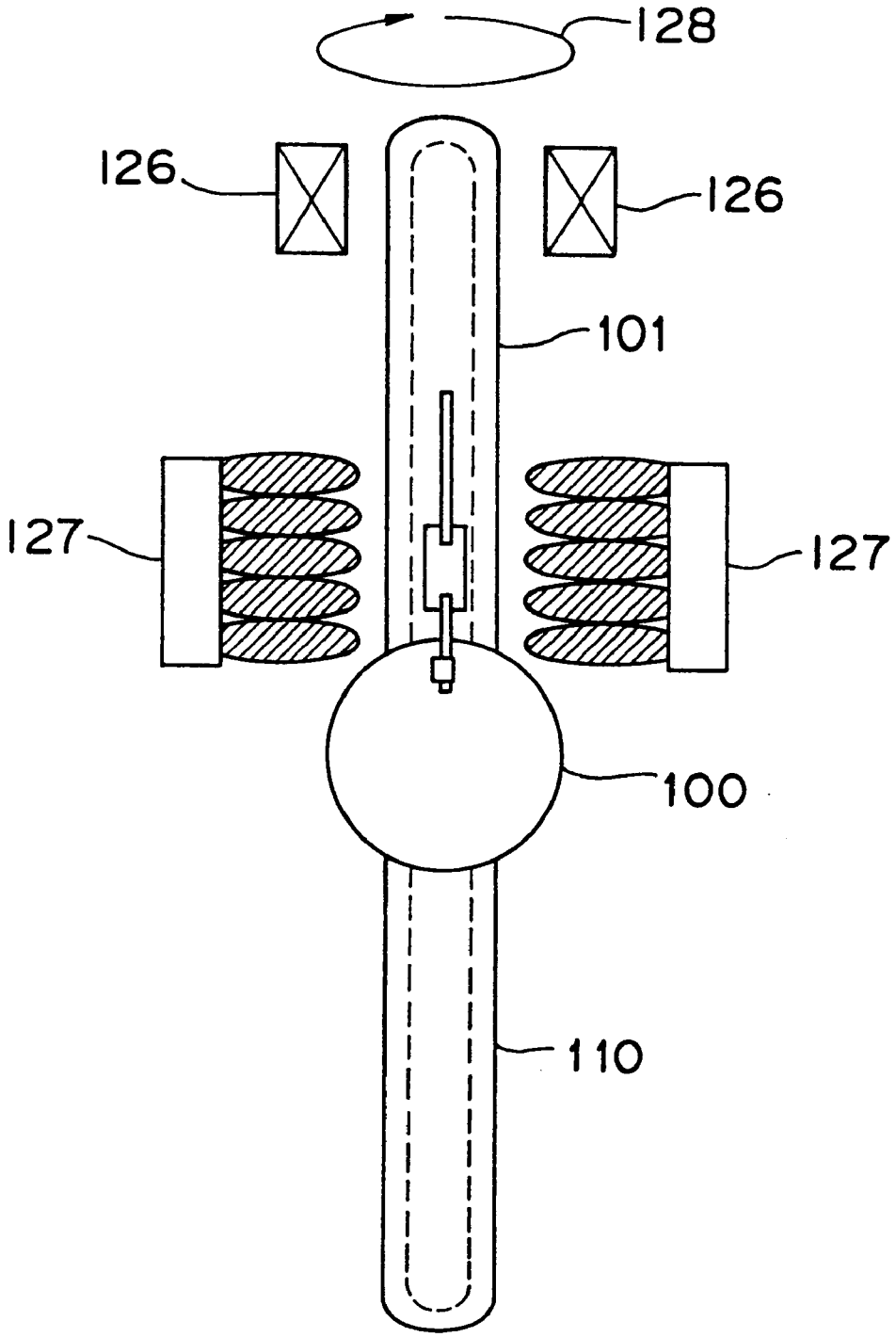
Fig. 14 PRIOR ART
FIG. 14 shows a manufacturing method (shrink seal) of a conventional discharge lamp.

Next, an embodiment of a process that hermetically seals electrode assembly 12 inside side tube portion 12*b* in the manufacturing method of the high intensity discharge lamp of the present invention will be described. FIG. 10 describes a manufacturing method for sealing utilizing high frequency dielectric heating.

In FIG. 10, 50 is a magnetron for carrying out high frequency dielectric heating, 51 is an antenna for emitting microwaves, 52 is a container sealed airtight by acrylic or similar material, and 53 is a waveguide for microwaves. One end of waveguide 53 is arranged inside sealed container 52. The internal portion of waveguide 53 located inside sealed container 52 is also hermetically sealed by a cover 64 that uses material such as teflon that allows microwaves to pass through on the inside of waveguide 53 located at the boundary between the atmosphere and sealed container 52. Waveguide 53 located within the atmosphere functions as 53*a* and waveguide 53 located inside sealed container 52 functions as 53*b*.

Furthermore, in FIG. 10, 54 is an open cylindrical hole that functions to arrange glass tube 10 inside waveguide 53 located within sealed container 52. A heat absorbing element (heating element) 55 comprising silicon or similar material is located on one portion of the circumference of hole 54 (used to arrange the lamp) for the purpose of heating the glass of side tube portion 12*b* and sealing electrode assembly 13. Heat absorbing element 55 has either a ring shape or a cylindrical shape. Further, heat absorbing element 55 is heated by microwaves and a high temperature occurs within the element. Moreover, 56 in FIG. 10 is an adiabatic material such as alumina to improve the efficiency of heat absorbing element 55. The adiabatic material 56 encircles the circumference of heat absorbing element 55.

Even further, 57 in FIG. 10 is a chuck that holds glass tube 10. A motor (not shown in the figure) is connected to chuck 57 and glass tube 10 mounted to chuck 57 rotates in the direction of the circumference of glass tube 10 as shown by arrow 60. Further, because chuck 57 is disposed such that it can move up and down by a drive means (not shown in the figure), glass tube 10 mounted to chuck 57 can move up and down its axial direction as indicated by arrow 61.

Even further, 62 in FIG. 10 is a compressor that functions to increase the pressure inside sealed container 52 to atmospheric pressure or more and 63 is a regulating valve that uniformly maintains the pressure inside sealed container 52. This regulating valve 63 can freely set the pressure inside the sealed container to atmospheric pressure or increase the pressure.

In the following, the process of the above embodiment will be described. At first, the glass of the first portion of side tube portion 12*b* positioned where electrode 20 is located heats and then the inside diameter of the glass of side tube portion 12*b* positioned where electrode 20 is located undergoes diameter reduction reaching to the area around electrode 20. This is described in detail below.

Atmospheric pressure is maintained inside sealed container 52. In this state chuck 57 is mounted to glass tube 10.

In other words, one end of side tube portion 12*b* is held by chuck 57 in order that the axis of heat absorbing element 55 matches the axis of side tube portion 12*b*. Next, the position of glass tube 10 is adjusted in order that heat absorbing element 55 is opposite to the first portion of side tube portion 12*b*. Continuing, glass tube 10 is made to rotate.

Next, microwaves generated from magnetron 50 heat-up heat absorbing element 55. Then, heat absorbing element 55 heats the first portion of side tube portion 12*b* positioned where rotating electrode 20 is located up to the softening point or more which in turn reduces the inside diameter of the first portion reaching to the area around electrode 20. For this case, because the inside of sealed container 52 is maintained at atmospheric pressure while the interior of the glass tube becomes lower than atmospheric pressure, the glass tube equally reduces the diameter around electrode 20 as shown at the right edge of FIG. 1 halfway down.

Then the heated side tube portion 12*b* cools to room temperature. The cooling of glass tube 10 can be done inside sealing device 52 or outside sealed container 52.

Continuing, by means of moving chuck 57 (that is retaining glass tube 10) in the downward direction, heat absorbing element 55 is brought opposite to the second portion. Then, along with glass tube 10 being rotated, the glass of the second portion of side tube portion 12*b* positioned where metal foil 21 is located heats. Further, compressor 62 increases the pressure (from 1 to 10 atmospheres) inside sealed container 52 to atmospheric pressure or more. In this manner the second portion is hermetically sealed.

This completes the electrode sealing of side tube portion 12*b*. The electrode sealing of side tube portion 12*a* is carried out in like manner.

Moreover, although the discharge lamp was described as examples in the second and third embodiments, the present invention can be applied to other types of lamps, such as incandescent lamps which employ electrode assembly with an airtight sealing method inside glass.

According to the present invention as described above, because there is no concentration of stress between the side tube portion glass positioned at the electrode portion and the electrode as well as the metal foil having a high adhesiveness, a lamp can be achieved with an excellent high pressure resistant structure that is difficult to crack.

What is claimed is:

1. A method of manufacturing a lamp, comprising:

inserting an electrode assembly into a side tube portion of a glass tube extending from a light emission portion of the glass tube, the electrode assembly being inserted into the side tube portion such that an axis of the side tube portion is approximately aligned with an axis of the electrode assembly;

positioning a first end of an electrode of the electrode assembly inside the light emission portion of the glass tube, wherein a second end of the electrode is connected to a metal foil of the electrode assembly;

shrinking the side tube portion of the glass tube, said shrinking comprising:

heating the side tube portion while rotating the side tube portion in a circumferential direction so as to uniformly heat the side tube portion, and applying a first pressure to the side tube portion by reducing a pressure inside the side tube portion below an external pressure outside the side tube portion, whereby the side tube portion is compressed; and applying a second pressure by pinching the side tube portion so as to compress a section of the side tube portion enclosing the metal foil of the electrode assembly, wherein the second pressure is larger than the first pressure, and wherein said applying of the second pressure is conducted after said shrinking of the side tube portion.

2. The method of claim 1, wherein the lamp is a discharge lamp.

3. The method of claim 1, wherein the lamp is an incandescent lamp.

4. The method of claim 1, wherein said shrinking of the side tube portion comprises uniformly heating a first portion of the side tube portion, a diameter of the first portion being reduced by a difference in the pressure inside the side tube portion and the external pressure, and wherein said applying of the second pressure comprises uniformly heating a second portion of the side tube portion and squeezing the second portion with a die.

5. The method of claim 1, wherein said shrinking of the side tube portion comprises uniformly heating a first portion of the side tube portion, a diameter of the first portion being reduced by a difference in the pressure inside the side tube portion and the external pressure, and wherein said applying of the second pressure comprises:

maintaining an external periphery of a second portion of the side tube portion at an external pressure equal to or greater than an atmospheric pressure; and uniformly heating the second portion such that a diameter of the second portion is reduced by a difference in the pressure inside the side tube portion and the external pressure.

6. The method of claim 1, further comprising filling the glass tube with an inert gas.

7. The method of claim 6, wherein the inert gas comprises argon gas.

8. A method of manufacturing a lamp, comprising:

inserting an electrode assembly into a side tube portion of a glass tube extending from a light emission portion of the glass tube, the electrode assembly being inserted into the side tube portion such that an axis of the side tube portion is approximately aligned with an axis of the electrode assembly;

positioning a first end of an electrode of the electrode assembly inside the light emission portion of the glass tube, wherein a second end of the electrode is connected to a metal foil of the electrode assembly;

shrinking the side tube portion of the glass tube, said shrinking comprising:

heating the side tube portion while rotating a heating element around a circumference of the side tube portion so as to uniformly heat the side tube portion, and applying a first pressure to the side tube portion by reducing a pressure inside the side tube portion below an external pressure outside the side tube portion, whereby the side tube portion is compressed; and applying a second pressure by pinching the side tube portion so as to compress a section of the side tube portion enclosing the metal foil of the electrode assembly, wherein the second pressure is larger than the first pressure, and wherein said applying of the second pressure is conducted after said shrinking of the side tube portion.

9. The method of claim 8, wherein the heating element comprises a burner.

10. The method of claim 8, wherein the heating element comprises a high-frequency dielectric heating element.

11. The method of claim 8, wherein the lamp is a discharge lamp.

12. The method of claim 8, wherein the lamp is an incandescent lamp.

13. The method of claim 8, wherein said shrinking of the side tube portion comprises uniformly heating a first portion of the side tube portion, a diameter of the first portion being reduced by a difference in the pressure inside the side tube portion and the external pressure, and wherein said applying of the second pressure comprises uniformly heating a second portion of the side tube portion and squeezing the second portion with a die.

14. The method of claim 8, wherein said shrinking of the side tube portion comprises uniformly heating a first portion of the side tube portion, a diameter of the first portion being reduced by a difference in the pressure inside the side tube portion and the external pressure, and wherein said applying of the second pressure comprises:

maintaining an external periphery of a second portion of the side tube portion at an external pressure equal to or greater than an atmospheric pressure; and uniformly heating the second portion such that a diameter of the second portion is reduced by a difference in the pressure inside the side tube portion and the external pressure.

15. The method of claim 8, further comprising filling the glass tube with an inert gas.

16. The method of claim 15, wherein the inert gas comprises argon gas.

* * * * *